US011643702B2

(12) United States Patent
Maeda et al.

(10) Patent No.: US 11,643,702 B2
(45) Date of Patent: May 9, 2023

(54) HIGH-STRENGTH HOT-DIP GALVANNEALED STEEL SHEET AND METHOD FOR PRODUCING SAME

(71) Applicant: JFE Steel Corporation, Tokyo (JP)

(72) Inventors: Satoshi Maeda, Tokyo (JP); Yoshiyasu Kawasaki, Tokyo (JP); Yusuke Fushiwaki, Tokyo (JP); Mai Aoyama, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 17/491,639

(22) Filed: Oct. 1, 2021

(65) Prior Publication Data

US 2022/0017986 A1 Jan. 20, 2022

Related U.S. Application Data

(62) Division of application No. 17/041,567, filed as application No. PCT/JP2019/012672 on Mar. 26, 2019.

(30) Foreign Application Priority Data

Mar. 28, 2018 (JP) ..... JP2018-063321

(51) Int. Cl.
*C21D 9/46* (2006.01)
*C21D 8/02* (2006.01)
(Continued)

(52) U.S. Cl.
CPC ..... *C21D 9/46* (2013.01); *C21D 6/00* (2013.01); *C21D 6/005* (2013.01); *C21D 6/008* (2013.01);
(Continued)

(58) Field of Classification Search
None
See application file for complete search history.

(56) References Cited

U.S. PATENT DOCUMENTS

2012/0090737 A1 4/2012 Fushiwaki et al.
2012/0222781 A1 9/2012 Azuma et al.
(Continued)

FOREIGN PATENT DOCUMENTS

CN 101514427 A 8/2009
CN 104018088 A 9/2014
(Continued)

OTHER PUBLICATIONS

Corean Office Action for Korean Application No. 10-2020-7027831, dated Mar. 8, 2022, with Concise Statement of Relevance of Office Action, 6 pages.
(Continued)

*Primary Examiner* — Anthony M Liang
(74) *Attorney, Agent, or Firm* — RatnerPrestia

(57) ABSTRACT

A method for producing a high-strength hot-dip galvannealed steel sheet, in which a high-strength steel sheet is used as a base material, includes a rolling step (x) of rolling a hot-dip galvannealed steel sheet with a coating layer having an Fe concentration of 8% to 17% by mass, and a heat treatment step (y) of heating the coated steel sheet which has been subjected to the rolling step (x) under the conditions satisfying the following formulae (1) and (2):

$$(273+T)\times(20+2\times\log_{10}(t))\geq 8000 \quad (1)$$

$$40\leq T\leq 160 \quad (2)$$

where T: heating temperature (° C.) of the coated steel sheet, and t: holding time (hr) at the heating temperature T.

3 Claims, 2 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/32*** | (2006.01) |
| ***C22C 38/60*** | (2006.01) |
| ***C23C 2/06*** | (2006.01) |
| ***C23C 2/28*** | (2006.01) |
| ***C23C 2/40*** | (2006.01) |
| ***C21D 6/00*** | (2006.01) |

(52) U.S. Cl.

CPC ..... *C21D 8/0205* (2013.01); *C21D 8/0226* (2013.01); *C21D 8/0247* (2013.01); *C21D 8/0263* (2013.01); *C21D 8/0273* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/32* (2013.01); *C22C 38/60* (2013.01); *C23C 2/06* (2013.01); *C23C 2/28* (2013.01); *C23C 2/40* (2013.01)

(56) References Cited

U.S. PATENT DOCUMENTS

| | | | |
|---|---|---|---|
| 2015/0017474 | A1 | 1/2015 | Harako et al. |
| 2019/0144963 | A1 | 5/2019 | Georges et al. |
| 2020/0308664 | A1 | 10/2020 | Maeda et al. |

FOREIGN PATENT DOCUMENTS

| | | | |
|---|---|---|---|
| EP | 2098600 | A1 | 9/2009 |
| EP | 2821521 | A1 | 1/2015 |
| EP | 2921569 | A1 | 9/2015 |
| EP | 3476957 | A1 | 5/2019 |
| JP | 02263971 | A | 10/1990 |
| JP | 07173646 | A | 7/1995 |
| JP | 0874021 | A | 3/1996 |
| JP | 11217660 | A | 8/1999 |
| JP | 2007154283 | A | 6/2007 |
| JP | 2015151605 | A | 8/2015 |
| JP | 2017145441 | A | 8/2017 |
| KR | 20020071578 | A | 9/2002 |
| WO | 2011065591 | A1 | 6/2011 |
| WO | 2014075405 | A1 | 5/2014 |
| WO | 2017187215 | A1 | 11/2017 |
| WO | 2018003407 | A1 | 1/2018 |

OTHER PUBLICATIONS

Chinese Office Action with Search Report for Chinese Application No. 201980022946.9, dated Feb. 28, 2022, 10 pages.

Extended European Search Report for European Application No. 19776493.9, dated Nov. 23, 2020, 8 pages.

International Search Report and Written Opinion for International Application No. PCT/JP2019/012672, dated Jun. 25, 2019, 6 pages.

Japanese Office Action for Japanese Application No. 2020-510848, dated Nov. 4, 2020 with Concise Statement of Relevance of Office Action, 5 pages.

Entire patent prosecution history of U.S. Appl. No. 17/041,567, filed Sep. 25, 2020, entitled, "High-Strength Hot-Dip Galvannealed Steel Sheet and Method for Producing Same."

Final Office Action for U.S. Appl. No. 17/041,567, dated Apr. 19, 2022, 15 pages.

Non Final Office Action for U.S. Appl. No. 17/041,567, dated Jan. 12, 2022, 22 pages.

HIGH-STRENGTH HOT-DIP GALVANNEALED STEEL SHEET AND METHOD FOR PRODUCING SAME

CROSS REFERENCE TO RELATED APPLICATIONS

This is a Divisional Application of U.S. application Ser. No. 17/041,567, filed Sep. 25, 2020 which is the U.S. National Phase application of PCT/JP2019/012672, filed Mar. 26, 2019, which claims priority to Japanese Patent Application No. 2018-063321, filed Mar. 28, 2018, the disclosures of these applications being incorporated herein by reference in their entireties for all purposes.

FIELD OF THE INVENTION

The present invention relates to a high-strength hot-dip galvannealed steel sheet containing a small amount of diffusible hydrogen and having excellent delayed fracture resistance, preferably a high-strength hot-dip galvannealed steel sheet further having excellent ductility and hole expandability, and methods for producing the same.

BACKGROUND OF THE INVENTION

In recent years, regarding steel sheets mainly used in the automobile field, from the viewpoint of weight reduction and improvement in crashworthiness, strengthening of steel sheets has advanced, and in hot-dip galvanized steel sheets having rust-preventing properties, steel sheets having strength of 980 MPa or more have begun to be widely used.

However, it is known that as the strength of steel is increased, a phenomenon referred to as "delayed fracture" is likely to occur. The delayed fracture intensifies with increasing of steel strength. Here, the delayed fracture is a phenomenon in which, when high-strength steel is under static load stress (load stress equal to or less than tensile strength) for a certain elapsed time, brittle fracture suddenly occurs substantially without apparent plastic deformation.

It is known that, in the case of steel sheets, the delayed fracture is caused by residual stress occurring when formed into a predetermined shape by press working and hydrogen embrittlement of steel at a stress concentration zone. The hydrogen that causes hydrogen embrittlement is considered, in most cases, to be hydrogen that has penetrated and diffused into steel from the external environment.

Baking treatment is known as a treatment for releasing (desorbing) hydrogen that has penetrated into the steel, out of the steel (e.g., Patent Literature 1). In the baking treatment, by heating the steel into which hydrogen has penetrated at a predetermined temperature (e.g., about 200° C.), hydrogen is diffused and released (desorbed) from the surface of the steel. Patent Literature 2 shows a method in which a hot-dip zinc-based coated steel sheet is subjected to baking treatment in a water vapor atmosphere.

However, since a hot-dipped coating layer has a larger thickness than that of an electroplated coating layer, it is difficult to efficiently release hydrogen from the surface of the steel sheet simply by subjecting the hot-dip zinc-based coated steel sheet to baking treatment (heat treatment). Therefore, improvement in delayed fracture resistance is likely to become insufficient, and also problems, such as occurrence of hydrogen blistering and prolongation of baking treatment time, arise.

Furthermore, in general, since strengthening of a steel sheet is accompanied by a deterioration in ductility, many techniques for strengthening without deteriorating ductility have been developed. Above all, a steel sheet in which higher ductility and higher strength are achieved by using strain-induced transformation of the austenite phase is widely known as a so-called TRIP steel sheet. Regarding the TRIP steel sheet, the austenite phase, which is a metastable phase, is retained in the final structure, and therefore, high Mn content steel sheets containing a large amount of Mn, which is an austenite-stabilizing element, have been developed (for example, Patent Literature 3). However, the present inventors have proceeded to develop high Mn content, high-strength, high-ductility steels, and as a result, have found that, while desired characteristics are obtained in cold-rolled steel sheets, hot-dip galvannealed steel sheets (hereinafter, for convenience of explanation, may be referred to as "GA steel sheets") have significant inferiority in ductility (total elongation) and hole expandability (critical hole expansion ratio) compared to cold-rolled steel sheets.

PATENT LITERATURE

PTL 1: Japanese Unexamined Patent Application Publication No. 7-173646

PTL 2: Japanese Unexamined Patent Application Publication No. 2017-145441

PTL 3: Japanese Unexamined Patent Application Publication No. 2007-154283

SUMMARY OF THE INVENTION

An object according to aspects of the present invention is to solve the problems in the existing techniques described above and to provide a high-strength hot-dip zinc-based coated steel sheet containing a small amount of diffusible hydrogen and having excellent delayed fracture resistance and a method for producing the same. Furthermore, another object according to aspects of the present invention is to provide a high-strength hot-dip zinc-based coated steel sheet further having excellent ductility and hole expandability and a method for producing the same.

The present inventors have conducted thorough studies to find a method capable of appropriately removing diffusible hydrogen contained in a hot-dip zinc-based coated steel sheet, in which the present inventors have paid attention to the fact that an Fe—Zn intermetallic compound constituting a coating layer of a GA steel sheet is a brittle material, and have conceived that, by causing an external force to act on an Fe—Zn intermetallic compound (coating layer), which is a brittle material, so that microcracks can be introduced thereinto, a hydrogen desorption path is secured, and then, by performing baking treatment, diffusible hydrogen contained in the steel sheet is released through the desorption path. Further studies have been conducted on the basis of such a conception, and as a result, it has been found that, by rolling (which may be rolling with relatively light reduction) a GA steel sheet with a coating layer having a predetermined Fe concentration, microcracks can be introduced into the coating layer, and by subjecting the rolled GA steel sheet to baking treatment under predetermined conditions, diffusible hydrogen can be appropriately removed from the steel sheet so that the amount of diffusible hydrogen in the steel sheet can be reduced to a predetermined level. That is, the present inventors have found a method capable of effectively removing diffusible hydrogen in a steel sheet by using the properties of a coating layer of a GA steel sheet which is different from an EG steel sheet (electro-galvanized steel sheet) or GI steel sheet (hot-dip galvanized steel sheet).

Furthermore, it is generally considered that diffusible hydrogen contained in a GA steel sheet is the one that has penetrated mainly in an annealing step in a CGL, and desorption of diffusible hydrogen is inhibited by hot-dip galvanizing which is subsequently performed. The present inventors have assumed that significant inferiority in ductility (total elongation) and hole expandability (critical hole expansion ratio) of a GA steel sheet including, as a base material, a high Mn content steel sheet which aims at high strength and high ductility, compared to a cold-rolled steel sheet, is caused by diffusible hydrogen in the steel sheet. Accordingly, the present inventors have used a method in which rolling is performed on a GA steel sheet including a high Mn content steel sheet as a base material and a coating layer having a predetermined Fe concentration so that microcracks are introduced into the coating layer, and then baking treatment is carried out. As a result, it has been found that ductility and hole expandability can be significantly improved.

It has also been found that, in such a method, baking treatment can be carried out at a relatively low temperature, and atmosphere control is not particularly required.

It has also been found that, according to such a method, baking treatment can be carried out at a relatively low temperature, and atmosphere control is not particularly required.

Aspects of the present invention have been made on the basis of the findings described above, and are as follows.

[1] A method for producing a high-strength hot-dip galvannealed steel sheet, in which a high-strength steel sheet is used as a base material, the method including a rolling step (x) of rolling a hot-dip galvannealed steel sheet with a coating layer having an Fe concentration of 8% to 17% by mass, and a heat treatment step (y) of heating the coated steel sheet which has been subjected to the rolling step (x) under the conditions satisfying the following formulae (1) and (2):

$$(273+T)\times(20+2\times\log_{10}(t))\geq 8000 \quad (1)$$

$$40\leq T\leq 160 \quad (2)$$

where T: heating temperature (° C.) of the coated steel sheet, and t: holding time (hr) at the heating temperature T.

[2] The method for producing a high-strength hot-dip galvannealed steel sheet according to [1], further including, before the rolling step (x), an annealing step (a) of annealing the steel sheet, a coating treatment step (b) of hot-dip galvanizing the steel sheet which has been subjected to the annealing step (a), and an alloying treatment step (c) of subjecting a coating layer obtained in the coating treatment step (b) to obtain the coating layer having an Fe concentration of 8% to 17% by mass.

[3] The method for producing a high-strength hot-dip galvannealed steel sheet according to [1] or [2], in which, in the rolling step (x), the coated steel sheet is rolled with light reduction at a rolling reduction of 0.10% to 1%.

[4] The method for producing a high-strength hot-dip galvannealed steel sheet according to any one of [1] to [3], in which the steel sheet has a composition containing, in percent by mass, C: 0.03% to 0.35%, Si: 0.01% to 2.00%, Mn: 2.0% to 10.0%, Al: 0.001% to 1.000%, P: 0.10% or less, and S: 0.01% or less with the balance being Fe and unavoidable impurities, and has a tensile strength of 980 MPa or more, and a product (TS×EL) of tensile strength (TS) and total elongation (EL) of 16,000 MPa·% or more; and the coating weight per one side of the coating layer is 20 to 120 g/m$^2$.

[5] The method for producing a high-strength hot-dip galvannealed steel sheet according to [4], in which the steel sheet further contains, in percent by mass, one or more selected from B: 0.001% to 0.005%, Nb: 0.005% to 0.050%, Ti: 0.005% to 0.080%, Cr: 0.001% to 1.000%, Mo: 0.05% to 1.00%, Cu: 0.05% to 1.00%, Ni: 0.05% to 1.00%, and Sb: 0.001% to 0.200%.

[6] The method for producing a high-strength hot-dip galvannealed steel sheet according to any one of [2] to [5], in which, in the annealing step (a), in accordance with the $Ac_1$ temperature and the $Ac_3$ temperature of the steel sheet, the steel sheet temperature (° C.) is set to be $[Ac_1+(Ac_3-Ac_1)/6]$ to 950° C., and the holding time at the corresponding temperature is set to be 60 to 600 seconds; and in the alloying treatment step (c), the alloying treatment temperature is set to be 460° C. to 650° C.

[7] The method for producing a high-strength hot-dip galvannealed steel sheet according to any one of [2] to [6], in which, in the annealing step (a), a region where the steel sheet temperature is 600° C. to 900° C. is set in an atmosphere having a $H_2$ concentration of 3% to 20% by volume, and a dew point of −60° C. to −30° C.

[8] A high-strength hot-dip galvannealed steel sheet, which includes a high-strength steel sheet serving as a base material, in which a coating layer has an Fe concentration of 8% to 17% by mass, and out of hydrogen being present in the steel sheet, the amount of hydrogen that is released when the temperature of the steel sheet is raised to 200° C. is 0.35 mass ppm or less.

[9] The high-strength hot-dip galvannealed steel sheet according to [8], in which the steel sheet has a composition containing, in percent by mass, C: 0.03% to 0.35%, Si: 0.01% to 2.00%, Mn: 2.0% to 10.0%, Al: 0.001% to 1.000%, P: 0.10% or less, and S: 0.01% or less with the balance being Fe and unavoidable impurities, and has a tensile strength of 980 MPa or more, and a product (TS×EL) of tensile strength (TS) and total elongation (EL) of 16,000 MPa·% or more; and the coating weight per one side of the coating layer is 20 to 120 g/m$^2$.

[10] The high-strength hot-dip galvannealed steel sheet according to [9], in which the steel sheet further contains, in percent by mass, one or more selected from B: 0.001% to 0.005%, Nb: 0.005% to 0.050%, Ti: 0.005% to 0.080%, Cr: 0.001% to 1.000%, Mo: 0.05% to 1.00%, Cu: 0.05% to 1.00%, Ni: 0.05% to 1.00%, and Sb: 0.001% to 0.200%.

[11] The high-strength hot-dip galvannealed steel sheet according to any one of [8] to [10], in which the average length (L) per unit area of microcracks introduced into the coating layer at the surface of the steel sheet is 0.010 μm/μm$^2$ or more and 0.070 μm/μm$^2$ or less, in which the percentage of cracks that extend in a direction substantially orthogonal to the rolling direction is 60% or less relative to the total length of all the cracks.

According to aspects of the present invention, it is possible to stably provide a high-strength hot-dip galvannealed steel sheet containing a small amount of diffusible hydrogen and having excellent delayed fracture resistance. Furthermore, in accordance with aspects of the present invention, by using a base steel sheet having a predetermined composition with a high Mn content, it is possible to stably provide a high-strength, high-ductility hot-dip galvannealed steel sheet further having excellent ductility and hole expandability.

DETAILED DESCRIPTION OF EMBODIMENTS OF THE INVENTION

Figure 1:
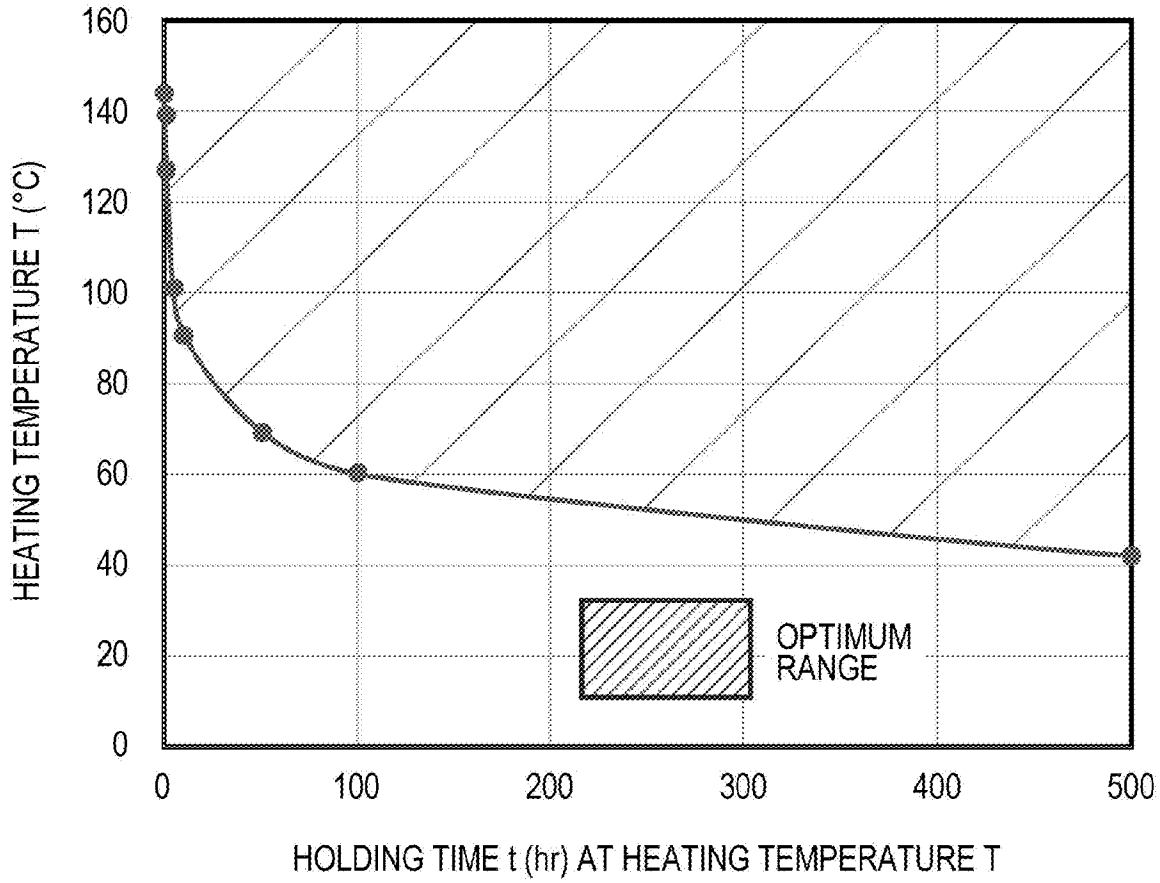
FIG. 1 is a graph showing the relationship between the heating temperature T satisfying the formula (1) and the holding time at the heating temperature T in the heat treatment step (y) according to aspects of the present invention.
Figure 2:
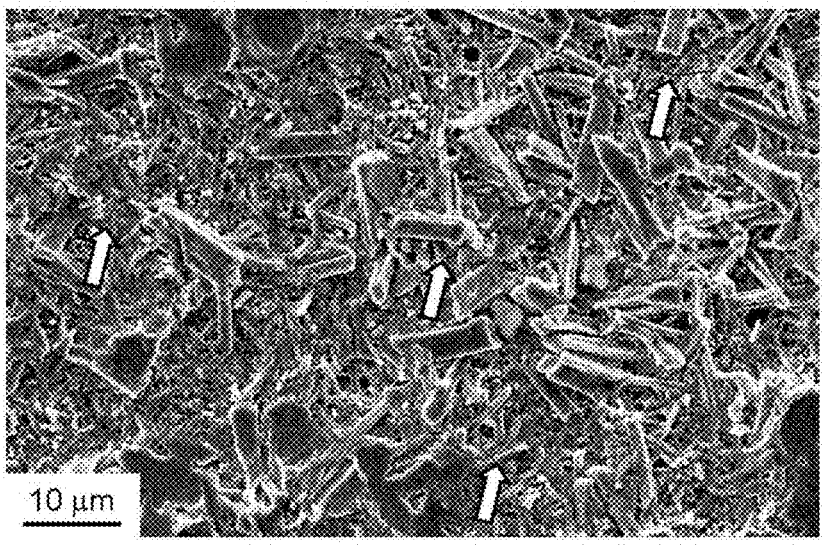
FIG. 2 is a figure showing an example of a surface of a steel sheet according to aspects of the present invention in Example No. 15.

High-strength hot-dip galvannealed steel sheets and methods for producing the same according to aspects of the present invention will be described in detail below.

A method for producing a high-strength hot-dip galvannealed steel sheet according to aspects of the present invention, in which a high-strength steel sheet is used as a base material, includes a rolling step (x) of rolling a hot-dip galvannealed steel sheet with a coating layer having an Fe concentration of 8% to 17% by mass, and a heat treatment step (y) of heating the coated steel sheet which has been subjected to the rolling step (x) under predetermined heating conditions.

In accordance with aspects of the present invention, the strength and the like of the high-strength steel sheet serving as a base material of the GA steel sheet are not particularly limited. However, in general, preferably, aspects of the present invention are directed to a steel sheet having a tensile strength of 590 MPa or more. Furthermore, above all, in the case where a steel sheet having a tensile strength of 980 MPa or more is used as a base material, problems due to diffusible hydrogen are likely to occur. Therefore, aspects of the present invention are more useful for a GA steel sheet in which a steel sheet having a tensile strength of 980 MPa or more is used as a base material, and still more useful for a GA steel sheet in which steel having a tensile strength of 1,180 MPa or more is used as a base material.

Furthermore, the production method according to aspects of the present invention can further include an annealing step, a coating treatment step, and an alloying treatment step, which are performed in a CGL or the like. That is, the production method includes an annealing step (a) of annealing the steel sheet, a coating treatment step (b) of hot-dip galvanizing the steel sheet which has been subjected to the annealing step (a), an alloying treatment step (c) of subjecting a coating layer obtained in the coating treatment step (b) to obtain a coating layer having an Fe concentration of 8% to 17% by mass, a rolling step (x) of rolling the coated steel sheet which has been subjected to the alloying treatment step (c), and a heat treatment step (y) of heating the coated steel sheet which has been subjected to the rolling step (x) under predetermined heating conditions.

In the production method according to aspects of the present invention, the brittleness of an Fe—Zn intermetallic compound constituting the coating layer of the GA steel sheet is utilized, and by rolling the GA steel sheet in the rolling step (x), microcracks, which form a hydrogen desorption path, are introduced into the coating layer, and then, baking treatment is carried out. In the rolling step (x), rolling may be performed at a relatively low rolling reduction (with light reduction), and by crushing the coating layer by the rolling, cracks are generated.

Here, in order to introduce microcracks serving as a hydrogen desorption path into the coating layer by performing rolling in the rolling step (x), the Fe concentration in the coating layer (hot-dip galvannealing layer) is important. Zn is a metal and therefore has ductility. Even when working, such as rolling, is imparted to the coating layer, unless the working ratio is extremely large, cracks do not occur in the coating layer. On the other hand, as alloying of Zn of the coating layer with Fe (base material) proceeds, the percentage of the Zn phase having ductility decreases (i.e., the percentage of the Fe—Zn intermetallic compound increases), and the coating layer becomes brittle. Therefore, cracks are likely to occur. In order to introduce a sufficient amount of cracks at a relatively low rolling reduction, the Fe concentration in the coating layer is preferably set to be 8% by mass or more. On the other hand, when alloying of Zn of the coating layer with Fe (base material) proceeds excessively, there is a concern that a brittle Γ phase may be formed at the steel sheet-coating interface, resulting in occurrence of powdering. Accordingly, in order to avoid such a problem, the Fe concentration in the coating layer is preferably set to be 17% by mass or less. For the reasons described above, in accordance with aspects of the present invention, the Fe concentration of the coating layer of the GA steel sheet to be subjected to the rolling step (x) is set to be 8% to 17% by mass. The Fe concentration of the coating layer is preferably 9% by mass or more. The reason for this is that the Zn phase having ductility completely disappears, microcracks can be uniformly introduced into the entire coating layer, and efficient desorption of hydrogen can be promoted. The Fe concentration of the coating layer is preferably 15% by mass or less. The reason for this is that, when the Fe concentration of the coating layer exceeds 15% by mass, a brittle Γ phase may be partially formed at the steel sheet-coating interface in some cases, cracks may concentrate in such portions, and there is a possibility that the hydrogen desorption rate will decrease in the portions where cracks are unlikely to be introduced.

The rolling reduction of the hot-dip galvannealed steel sheet in the rolling step (x) is not particularly limited. When the rolling reduction is excessively small, introduction of cracks into the coating layer becomes insufficient. On the other hand, when the rolling reduction is excessively large, workability is deteriorated (ductility is deteriorated by introduction of strains). Therefore, in general, preferably, rolling is performed at a rolling reduction of about 0.10% to 1% (rolling is performed with light reduction). Note that the rolling means used in the rolling step (x) may be a commonly used rolling mill and reduction rolls. The rolling reduction is more preferably 0.2% or more. The rolling reduction is more preferably 1.0% or less, and still more preferably 0.5% or less for the purpose of introducing cracks which will be described later.

When cracks are introduced into the coating layer by rolling, in many cases, cracks are introduced in a direction orthogonal to the rolling direction. However, if many cracks are introduced in the same direction, when the GA steel sheet serving as automobile parts is subjected to press working, there is an increased occurrence of peel-off of coating, which may lead to powdering. Even in the case where powdering is not brought about, anti-powdering properties are deteriorated compared with a case where cracks are not introduced in a fixed direction. In order to avoid such a problem, preferably, the percentage of the length of cracks that extend in a direction substantially orthogonal to the rolling direction is 60% or less relative to the total length of all the cracks. The percentage of the length of cracks that extend in a direction substantially orthogonal to the rolling direction is more preferably 55% or less, and still more preferably 50% or less, relative to the total length of all the cracks. In accordance with aspects of the present invention, the term "rolling direction" refers to a direction in which the steel sheet to be rolled is passed. Furthermore, the expression "direction substantially orthogonal to the rolling direction" refers to, as will also be described in Examples below, a direction at an angle in a range of 80° to 100° with respect to the direction in which the steel sheet to be rolled is passed.

Furthermore, in order to suppress deterioration in anti-powdering properties while securing a hydrogen desorption path, preferably, the average length (L) per unit area of microcracks introduced into the coating layer is 0.010 $\mu m/\mu m^2$ or more and 0.070 $\mu m/\mu m^2$ or less. The average length (L) is more preferably 0.020 $\mu m/\mu m^2$ or more, and still more preferably 0.030 $\mu m/\mu m^2$ or more. The average length (L) is more preferably 0.075 $\mu m/\mu m^2$ or less, and still more preferably 0.060 $\mu m/\mu m^2$ or less.

In order to introduce such cracks, preferably, the rolling reduction is set to be 0.10% to 0.5%, and the work roll diameter at the time of rolling (rolling with light reduction) is set to be 600 mm or less. The reason for this is that, when the rolling reduction is less than 0.1%, introduction of microcracks becomes insufficient, and when the rolling reduction exceeds 0.5%, the average length (L) per unit area of microcracks exceeds 0.07 $\mu m/\mu m^2$, resulting in deterioration in anti-powdering properties. The rolling reduction is more preferably 0.2% or more. The rolling reduction is more preferably 0.4% or less. The reason for this is also that, when the work roll diameter exceeds 600 mm, the contact area between the steel sheet and the roll increases during rolling, thereby increasing the time in which the force is imparted by the roll in the shearing direction (rolling direction), and cracks become likely to be introduced in a direction orthogonal to the rolling direction. The work roll diameter is more preferably 500 mm or less.

The surface roughness of the work roll used in rolling (rolling with light reduction) is preferably 1.5 μm or less. The surface roughness of the work roll used in rolling (rolling with low pressure) is preferably 1.0 μm or more.

In the heat treatment step (y), heat treatment (baking treatment) for the purpose of removing diffusible hydrogen) is performed on the GA steel sheet which has been subjected to the rolling step (x).

In the heat treatment step (y), in the case where the heating temperature is relatively high, there is a concern that the temperature inside the coil may become uneven, resulting in a variation in mechanical properties inside the coil. Furthermore, in order to appropriately eliminate diffusible hydrogen, as the heating temperature is decreased, the heating time (holding time) needs to be extended. From these standpoints, in accordance with aspects of the present invention, the coated steel sheet is heated under the conditions satisfying the formulae (1) and (2) below. Furthermore, more preferably, the coated steel sheet is heated under the conditions satisfying the formulae (1) and (3) below. FIG. 1 shows the relationship between the heating temperature T satisfying the formula (1) and the holding time t at the heating temperature T.

$$(273+T)\times(20+2\times\log_{10}(t))\geq 8000 \quad (1)$$

$$40\leq T\leq 160 \quad (2)$$

$$60\leq T\leq 120 \quad (3)$$

where T: heating temperature (° C.) of the coated steel sheet, and t: holding time (hr) at the heating temperature T.

In accordance with aspects of the present invention, desirably, the heating conditions in the heat treatment step (y) comply with the formulae (1) and (2). However, the heat treatment may be carried out on wider heating conditions, and for example, the holding time may be set to be about 1 to 500 hours regardless of the heating temperature. The heating time is more preferably 5 hours or more, and still more preferably 8 hours or more. The heating time is more preferably 300 hours or less, and still more preferably 100 hours or less.

In accordance with aspects of the present invention, since microcracks serving as a hydrogen desorption path have been introduced into the coating layer in the rolling step (x), diffusible hydrogen can be properly desorbed even at a relatively low heating temperature. However, under the conditions according to the formula (2), when the heating temperature T is less than 40° C., diffusion of hydrogen does not occur sufficiently, and therefore, the amount of diffusible hydrogen in the steel sheet cannot be reduced sufficiently, or a large number of days is required for the heat treatment, resulting in a decrease in productivity. On the other hand, when the heating temperature T exceeds 160° C., there is a possibility that the temperature inside the coil may become uneven, resulting in a variation in mechanical properties inside the coil. Furthermore, when the conditions according to the formula (1) are satisfied, it is possible to secure the heating time according to the heating temperature. Therefore, by heating the coated steel sheet under the conditions satisfying the formulae (1) and (2), and preferably under the conditions satisfying the formulae (1) and (3), it is possible to reduce the amount of diffusible hydrogen to a desired, sufficiently low level without causing a variation in mechanical properties in the GA steel sheet.

The heat treatment step (y) can be performed in the air atmosphere without particularly requiring atmosphere control. Furthermore, heating facilities used are not particularly limited, and for example, a warehouse equipped with an electric furnace or gas heating furnace may be used.

The details of aspects of the present invention and preferable conditions will be described below. First, a high-strength steel sheet serving as a base material of a GA steel sheet will be described. In the following description, the unit used to express the content of each element is "percent by mass", and for convenience, is expressed as "%".

In accordance with aspects of the present invention, the composition of the high-strength steel sheet serving as a base material of the GA steel sheet is not particularly limited. In the case where a high Mn content, high-strength, high-ductility steel GA steel is produced, the composition preferably contains, as basic components, C: 0.03% to 0.35%, Si: 0.01% to 2.00%, Mn: 2.0% to 10.0%, Al: 0.001% to 1.000%, P: 0.10% or less, and S: 0.01% or less, and optionally can contain one or more selected from B: 0.001% to 0.005%, Nb: 0.005% to 0.050%, Ti: 0.005% to 0.080%, Cr: 0.001% to 1.000%, Mo: 0.05% to 1.00%, Cu: 0.05% to 1.00%, Ni: 0.05% to 1.00%, and Sb: 0.001% to 0.200%. Reasons for these limitations will be described below.

C: 0.03% to 0.35%

C is an element that has the effect of enhancing the strength of the steel sheet, and therefore, the C content is preferably 0.03% or more. On the other hand, when the C content exceeds 0.35%, weldability, which is required when used as materials for automobiles and home electrical appliances, is deteriorated, and therefore, the C content is preferably 0.35% or less. The C content is more preferably 0.05% or more, and still more preferably 0.08% or more. The C content is more preferably 0.30% or less, and still more preferably 0.28% or less.

Si: 0.01% to 2.00%

Si is an element that is effective in strengthening steel and improving ductility, and therefore, the Si content is preferably 0.01% or more. On the other hand, when the Si content exceeds 2.00%, Si forms oxides on the surface of the steel sheet, resulting in deterioration in the appearance of coating, and therefore, the Si content is preferably 2.00% or less. The Si content is more preferably 0.02% or more, and still more preferably 0.05% or more. The Si content is more preferably 1.80% or less, and still more preferably 1.70% or less.

Mn: 2.0% to 10.0%

Mn is an element that stabilizes the austenite phase and largely improves ductility and is an important element in the high-strength, high-ductility GA steel sheet. In order to obtain such effects, the Mn content is preferably 0.1% or more, and desirably 2.0% or more. On the other hand, when the Mn content exceeds 10.0%, castability of slab and weldability are deteriorated, and therefore, the Mn content is preferably 10.0% or less. The Mn content is more preferably 2.50% or more, and still more preferably 3.00% or more. The Mn content is more preferably 8.50% or less, and still more preferably 8.00% or less.

Al: 0.001% to 1.000%

Al is added for the purpose of deoxidation of molten steel. However, when the Al content is less than 0.001%, the purpose is not attained. On the other hand, when the Al content exceeds 1.000%, Al forms oxides on the surface of the steel sheet, resulting in deterioration in the appearance of coating (surface appearance). Therefore, the Al content is preferably 0.001% to 1.000%. The Al content is more preferably 0.005% or more, and still more preferably 0.010% or more. The Al content is more preferably 0.800% or less, and still more preferably 0.500% or less.

P: 0.10% or Less

P is one of the unavoidably contained elements, and as the P content increases, slab manufacturability deteriorates. Furthermore, incorporation of P suppresses the alloying reaction and causes uneven coating. Therefore, the P content is preferably 0.10% or less, and more preferably 0.05% or less. On the other hand, when the P content is set to be less than 0.005%, the increase in cost is of concern. Therefore, the P content is desirably 0.005% or more. The P content is more preferably 0.05% or less, and still more preferably 0.01% or less. The P content is more preferably 0.007% or more, and still more preferably 0.008% or more.

S: 0.01% or Less

S is an element that is unavoidably contained in the steel making process. When a large amount of S is contained, weldability deteriorates, and therefore, the S content is preferably 0.01% or less. The S content is more preferably 0.08% or less, and still more preferably 0.006% or less. The S content is more preferably 0.001% or more, and still more preferably 0.002% or more.

B: 0.001% to 0.005%

When the B content is 0.001% or more, the hardening-accelerating effect can be obtained. On the other hand, when the B content exceeds 0.005%, chemical conversion treatability deteriorates. Therefore, when B is incorporated, the content thereof is preferably 0.001% to 0.005%. When B is incorporated, the content thereof is more preferably 0.002% or more. When B is incorporated, the content thereof is more preferably 0.004% or less.

Nb: 0.005% to 0.050%

When the Nb content is 0.005% or more, the strength adjustment (strength improvement) effect can be obtained. On the other hand, the Nb content exceeding 0.050% leads to an increase in cost. Therefore, when Nb is incorporated, the content thereof is preferably 0.005% to 0.050%. When Nb is incorporated, the content thereof is more preferably 0.01% or more, and still more preferably 0.02% or more. When Nb is incorporated, the content thereof is more preferably 0.045% or less, and still more preferably 0.040% or less.

Ti: 0.005% to 0.080%

When the Ti content is 0.005% or more, the strength adjustment (strength improvement) effect can be obtained. On the other hand, when the Ti content exceeds 0.080%, chemical conversion treatability deteriorates. Therefore, when Ti is incorporated, the content thereof is preferably 0.005% to 0.080%. When Ti is incorporated, the content thereof is more preferably 0.010% or more, and still more preferably 0.015% or more. When Ti is incorporated, the content thereof is more preferably 0.070% or less, and still more preferably 0.060% or less.

Cr: 0.001% to 1.000%

When the Cr content is 0.001% or more, the hardenability effect can be obtained. On the other hand, when the Cr content exceeds 1.000%, Cr is concentrated on the surface of the steel sheet, resulting in deterioration in weldability. Therefore, when Cr is incorporated, the content thereof is preferably 0.001% to 1.000%. When Cr is incorporated, the content thereof is more preferably 0.005% or more, and still more preferably 0.100% or more. When Cr is incorporated, the content thereof is more preferably 0.950% or less, and still more preferably 0.900% or less.

Mo: 0.05% to 1.00%

When the Mo content is 0.05% or more, the strength adjustment (strength improvement) effect can be obtained. On the other hand, the Mo content exceeding 1.00% leads to an increase in cost. Therefore, when Mo is incorporated, the content thereof is preferably 0.05% to 1.00%. When Mo is incorporated, the content thereof is more preferably 0.08% or more. When Mo is incorporated, the content thereof is more preferably 0.80% or less.

Cu: 0.05% to 1.00%

When the Cu content is 0.05% or more, the effect of accelerating formation of retained γ phase can be obtained. On the other hand, the Cu content exceeding 1.00% leads to an increase in cost. Therefore, when Cu is incorporated, the content thereof is preferably 0.05% to 1.00%. When Cu is incorporated, the content thereof is more preferably 0.08% or more, and still more preferably 0.10% or more. When Cu is incorporated, the content thereof is more preferably 0.80% or less, and still more preferably 0.60% or less.

Ni: 0.05% to 1.00%

When the Ni content is 0.05% or more, the effect of accelerating formation of retained γ phase can be obtained. On the other hand, the Ni content exceeding 1.00% leads to an increase in cost. Therefore, when Ni is incorporated, the content thereof is preferably 0.05% to 1.00%. When Ni is incorporated, the content thereof is more preferably 0.10% or more, and still more preferably 0.12% or more. When Ni is incorporated, the content thereof is more preferably 0.80% or less, and still more preferably 0.50%.

Sb: 0.001% to 0.200%

Sb can be incorporated from the viewpoint of suppressing decarbonization of a region of several tens of micrometers in the surface layer of the steel sheet, which is caused by nitriding and/or oxidation of the surface of the steel sheet. By suppressing nitriding or oxidation, it is possible to prevent a decrease in the amount of martensite formed at the surface of the steel sheet, thus improving fatigue properties and surface quality. Such an effect can be obtained at a Sb content of 0.001% or more. On the other hand, when the Sb content exceeds 0.200%, toughness is deteriorated. Therefore, when Sb is incorporated, the content thereof is preferably 0.001% to 0.200%. When Sb is incorporated, the content thereof is more preferably 0.003% or more, and still more preferably 0.005% or more. When Sb is incorporated, the content thereof is more preferably 0.100% or less, and still more preferably 0.080% or less.

The balance, other than the above-described basic components and components to be optionally added, consists of Fe and unavoidable impurities.

Furthermore, in order to obtain a high-strength, high-ductility GA steel sheet, preferably, the steel sheet (base steel sheet) has a tensile strength of 980 MPa or more, and a product (TS×EL) of tensile strength (TS) and total elongation (EL) of 16,000 MPa·% or more.

Here, the tensile strength (TS) and the total elongation (EL) are measured by a tensile test. The tensile test is performed in accordance with JIS 22241 (2011), in which, by using a JIS NO. 5 test specimen taken as a sample from the steel sheet such that the tensile direction corresponds to a direction orthogonal to the rolling direction of the steel sheet, the tensile strength (TS) and the total elongation (EL) are measured.

Next, the steps (a) to (c) in the production method according to aspects of the present invention will be described.

Annealing Step (a)

In the annealing step (a), the annealing conditions are not particularly limited. However, in order to ensure an optimum strength-ductility balance, in particular, a strength-ductility balance in the GA steel sheet in which the high Mn content steel sheet having the composition described above is used as a base material, preferably, in accordance with the $Ac_1$ temperature and the $Ac_3$ temperature of the steel sheet, the steel sheet temperature (° C.) is set to be $[Ac_1+(Ac_3-Ac_1)/6]$ to 950° C., and the holding time at the corresponding temperature is set to be 60 to 600 seconds. Furthermore, the steel sheet temperature (° C.) is more preferably set to be $[Ac_1+(Ac_3-Ac_1)/6]$ to 900° C. The steel sheet temperature (° C.) is still more preferably set to be 870° C. or less. The steel sheet temperature (° C.) is more preferably set to be 650° C. or more, and still more preferably set to be 670° C. or more.

Note that the $Ac_1$ temperature (° C.) and the $Ac_3$ temperature (° C.) of the steel sheet can be obtained from the following formulae:

$$Ac_3 \text{ temperature (° C.)}=937.2-436.5C+56Si-19.7Mn-16.3Cu-26.6Ni-4.9Cr+38.1Mo+124.8V+136.3Ti-19.1Nb+198.4Al+3315B$$

$$Ac_1 \text{ temperature (° C.)}=750.8-26.6C+17.6Si-11.6Mn-22.9Cu-23Ni+24.1Cr+22.5Mo-39.7V-5.7Ti+232.4Nb-169.4Al-894.7B$$

In the above formulae, C, Si, Mn, Cu, Ni, Cr, Mo, V, Ti, Nb, Al, and B represent the contents (% by mass) of the respective elements.

The main purpose of annealing in a CGL or the like is improvement in workability due to recrystallization of the worked structure of the steel sheet and structure formation before cooling. By setting the steel sheet temperature (° C.) to be $[Ac_1+(Ac_3-Ac_1)/6]$ or more, the amount of austenite phase at annealing can be 20% by volume or more. By subsequently performing cooling, martensite, tempered martensite, bainite, and retained austenite structures are formed. Since martensite and tempered martensite are responsible for strength and retained austenite is responsible for elongation, excellent strength and elongation can be achieved. On the other hand, when the steel sheet temperature (° C.) exceeds 950° C., the strength-ductility balance is deteriorated due to coarsening of crystal grains of the steel sheet. Therefore, the steel sheet temperature (° C.) is preferably set to be $[Ac_1+(Ac_3-Ac_1)/6]$ to 950° C. The steel sheet temperature (° C.) is more preferably set to be 900° C. or less, and still more preferably set to be 870° C. or less. The steel sheet temperature (° C.) is more preferably set to be 650° C. or more, and still more preferably 670° C. or more.

Furthermore, when the holding time at the steel sheet temperature (° C.) is less than 60 seconds, since recrystallization does not proceed sufficiently, there is a concern that the workability of the steel sheet may be deteriorated. On the other hand, when the holding time exceeds 600 seconds, the amount of hydrogen penetrating into the steel sheet increases, and even when the rolling step (x) and the heat treatment step (y) are performed, there is a concern that the amount of diffusible hydrogen in the steel sheet may not be reduced sufficiently. Therefore, the holding time at the steel sheet temperature (° C.) is preferably set to be 60 to 600 seconds. The holding time at the steel sheet temperature (° C.) is more preferably set to be 500 seconds or less. The holding time at the steel sheet temperature (° C.) is more preferably set to be 30 seconds or more.

Furthermore, in the annealing step (a), preferably, a region where the steel sheet temperature is 600° C. to 900° C. is set in an atmosphere having a $H_2$ concentration of 3% to 20% by volume, and a dew point of −60° C. to −30° C. Furthermore, the $H_2$ concentration is more preferably 5% to 15% by volume. The $H_2$ concentration is still more preferably 12% by volume or less. The dew point is more preferably −15° C. or less. The dew point is more preferably −20° C. or more.

In annealing in a CGL or the like, by heating the steel sheet in a reducing atmosphere, surface oxidation is prevented, and it is possible to suppress a decrease in wettability with respect to molten zinc. Such annealing in a reducing atmosphere is sufficiently effective when performed by setting the steel sheet temperature in a range of 600° C. to 900° C. at which the reaction rate is high. In order to obtain this effect, the $H_2$ concentration in the annealing atmosphere is preferably 3% by volume or more. On the other hand, when the $H_2$ concentration exceeds 20% by volume, the amount of hydrogen penetrating into the steel sheet increases, and even when the rolling step (x) and the heat treatment step (y) are performed, there is a concern that the amount of diffusible hydrogen in the steel sheet may not be reduced sufficiently.

Furthermore, by setting the steel sheet temperature in a range of 600° C. to 900° C. at which the reaction rate is high and by controlling the dew point in the annealing atmosphere, it is possible to control internal oxidation of the steel sheet. A reaction in which internal oxidation is caused by water vapor is expressed by the formula below, where M is an alloying element. Note that the steel sheet temperature (° C.) is more preferably 870° C. or less, and still more preferably 860° C. or less. The steel sheet temperature (° C.) is more preferably 620° C. or more, and still more preferably 640° C. or more.

$$M+XH_2O=MO_x+XH_2$$

Hydrogen generated by this reaction is likely to remain in the steel. When the dew point of the annealing atmosphere is more than −30° C., the amount of hydrogen generated by internal oxidation increases, and even when the rolling step (x) and the heat treatment step (y) are performed, there is a concern that the amount of diffusible hydrogen in the steel sheet may not be reduced sufficiently. On the other hand, even when the dew point is set to be less than −60° C., the effect obtained by controlling the dew point is saturated, rather deteriorating economic efficiency.

For the reasons described above, in the annealing step (a), preferably, a region where the steel sheet temperature is 600° C. to 900° C. is set in an atmosphere having a $H_2$ concentration of 3% to 20% by volume, and a dew point of −60° C. to −30° C. The $H_2$ concentration is more preferably 5% by volume or more. The $H_2$ concentration is more preferably 15% by volume or less. The dew point is more preferably −55° C. or more, and still more preferably −50° C. or more. The dew point is more preferably −35° C. or less. Note that, the atmosphere in other regions is optional as long as it is a non-oxidizing atmosphere.

Coating Treatment Step (b)

In the coating treatment step (b), the steel sheet, which has been annealed in the annealing step (a) and then cooled to a predetermined temperature, is immersed in a hot dip galvanizing bath and subjected to hot-dip galvanizing treatment. In the coated steel sheet taken out of the hot-dip galvanizing bath, usually, coating weight adjustment is performed by gas wiping or the like. The coating treatment conditions are not particularly limited. However, the coating weight (coating weight per one side) is preferably 20 g/m$^2$ or more from the viewpoint of corrosion resistance and coating weight control and is preferably 120 g/m$^2$ or less from the viewpoint of adhesion. The coating weight is more preferably 25 g/m$^2$ or more, and still more preferably 30 g/m$^2$ or more. The coating weight is more preferably 100 g/m$^2$ or less, and still more preferably 70 g/m$^2$ or less.

The composition of the hot-dip galvanizing bath is the same as the existing one and may contain, as coating components other than Zn, for example, an appropriate amount of one or more of Al, Mg, Si, and the like (the balance being Zn and unavoidable impurities). Specifically, the Al concentration in the bath is preferably about 0.001% to 0.2% by mass. The Al concentration in the bath is more preferably 0.01% or more, and still more preferably 0.05% or more. The Al concentration in the bath is more preferably 0.17% or less, and still more preferably 0.15% or less. Furthermore, besides Al, Mg, and Si, even when elements, such as Pb, Sb, Fe, Mg, Mn, Ni, Ca, Ti, V, Cr, Co, and Sn, are mixed in the coating bath, the effects according to aspects of the present invention are not impaired.

Alloying Treatment Step (c)

In the alloying treatment step (c), by heating the steel sheet which has been subjected to the coating treatment step (b), the hot-dip galvanizing layer is subjected to alloying treatment. The alloying treatment conditions are not particularly limited. However, the alloying treatment temperature (highest temperature reached of the steel sheet) is preferably 460° C. to 650° C., and more preferably 480° C. to 570° C. When the alloying treatment temperature is less than 460° C., the alloying reaction rate decreases, and there is a concern that the desired Fe concentration of the coating layer may not be obtained. On the other hand, when the alloying treatment temperature exceeds 650° C., a Zn—Fe alloy layer, which is hard and brittle, is thickly formed at the metal interface by over-alloying, and there is a concern that coating adhesion may be deteriorated, and there is a concern that the retained austenite phase may be decomposed, resulting in a deterioration in the strength-ductility balance. The alloying treatment temperature (highest temperature reached of the steel sheet) is still more preferably 550° C. or less. The alloying treatment temperature (highest temperature reached of the steel sheet) is still more preferably 490° C. or more.

The GA steel sheet obtained by undergoing the annealing step (a), the coating treatment step (b), and the alloying treatment step (c) is subjected to the rolling step (x) and the heat treatment step (y) under the conditions described above. In this way, the amount of diffusible hydrogen can be reduced to a sufficiently low level, and a high-strength GA steel sheet having excellent delayed fracture resistance can be obtained. Furthermore, as described above, by using a base steel sheet having a predetermined composition with a high Mn content, a high-strength, high-ductility GA steel sheet further having excellent ductility and hole expandability can be obtained.

Next, the constitution of the high-strength GA steel sheet according to aspects of the present invention will be described.

A high-strength GA steel sheet according to aspects of the present invention can be obtained by the production method according to aspects of the present invention described above and is a GA steel sheet including a high-strength steel sheet serving as a base material. In the high-strength GA steel sheet, a coating layer has an Fe concentration of 8% to 17% by mass, and out of hydrogen being present in the steel sheet, the amount of hydrogen that is released when the temperature of the steel sheet is raised to 200° C. is 0.35 mass ppm or less.

First, in the high-strength GA steel sheet according to aspects of the present invention, the reasons for limiting the Fe concentration of the coating layer to 8% to 17% by mass are the same as those described above. Furthermore, the preferred tensile strength (TS) of the steel sheet and the reasons therefor are the same as those described above.

Furthermore, as the indicator for the amount of diffusible hydrogen contained in the base material (steel sheet) of the GA steel sheet, "out of hydrogen being present in the steel sheet, the amount of hydrogen that is released when the temperature of the steel sheet is raised to 200° C. is 0.35 mass ppm or less" is used, which means that the amount of diffusible hydrogen is sufficiently reduced, and thereby, excellent delayed fracture resistance is exhibited. Furthermore, as described above, by using a steel sheet having a predetermined composition with a high Mn content as a base steel sheet, excellent ductility and hole expandability can be further achieved. The amount of hydrogen released is preferably 0.20 mass ppm or less. The amount of hydrogen released is more preferably 0.10 mass ppm or less. Although the amount of hydrogen released is preferably close to 0 as much as possible, long-term heat treatment leads to an increase in production cost. Therefore, an amount of residual hydrogen of 0.02 mass ppm or less, which does not greatly affect the quality of material, is acceptable.

Here, "out of hydrogen being present in the steel sheet, the amount of hydrogen that is released when the temperature of the steel sheet is raised to 200° C." can be measured as follows. First, coating layers on the front and back sides of the GA steel sheet are removed. As the removal method, the coating layers may be physically ground using a Leutor or the like, or the coating layers may be chemically dissolved and removed using an alkali. However, in the case of physically grinding, the grinding amount for the steel sheet is set to be 5% or less of the sheet thickness. After the coating layers are removed, the amount of hydrogen in the test specimen is measured by programmed temperature gas chromatography. In the gas chromatography, the temperature reached at the time of temperature rise of the test specimen is set to be 200° C. The rate of temperature rise is not particularly limited, but when it is excessively high, there is a concern that accurate measurement may not be possible. Therefore, the rate of temperature rise is preferably 500° C./hr or less, and particularly preferably about 200° C./hr. The rate of temperature rise is still more preferably about 100° C./hr. The value obtained by dividing the amount of hydrogen thus measured by the mass of the steel sheet is defined as "out of hydrogen being present in the steel sheet, the amount of hydrogen that is released when the temperature of the steel sheet is raised to 200° C. (mass ppm)". Note that, usually, the temperature is raised from room temperature. Specifically, room temperature is, for example, 20° C.

Furthermore, among high-strength GA steel sheets according to aspects of the present invention, in a high Mn content, high-strength, high-ductility GA steel sheet as described above, preferably, in addition to the constitution described above, the steel sheet has a composition containing, in percent by mass, C: 0.03% to 0.35%, Si: 0.01% to 2.00%, Mn: 2.0% to 10.0%, Al: 0.001% to 1.000%, P: 0.10% or less, and S: 0.01% or less, and optionally, further containing one or more selected from B: 0.001% to 0.005%, Nb: 0.005% to 0.050%, Ti: 0.005% to 0.080%, Cr: 0.001% to 1.000%, Mo: 0.05% to 1.00%, Cu: 0.05% to 1.00%, Ni: 0.05% to 1.00%, and Sb: 0.001% to 0.200%, with the balance being Fe and unavoidable impurities, and has a tensile strength of 980 MPa or more, and a product (TS×EL) of tensile strength (TS) and total elongation (EL) of 16,000 MPa·% or more; and the coating weight per one side of the coating layer is 20 to 120 g/m$^2$. In this GA steel sheet, the reasons for limiting the composition of the base material, the mechanical properties, and the coating weight are the same as those described above.

Furthermore, since the GA steel sheet according to aspects of the present invention has been subjected to the rolling step (x), the coating layer has microcracks.

Furthermore, since the GA steel sheet according to aspects of the present invention has been subjected to the rolling step (x), the coating layer has a slightly crushed structure, and therefore, has microcracks.

Furthermore, among high-strength GA steel sheets according to aspects of the present invention, the high Mn content, high-strength, high-ductility GA steel sheet having a specific composition as described above has excellent hole expandability. Here, the excellent hole expandability means that, according to the tensile strength TS, the critical hole expansion ratio λ (the method of measuring the critical hole expansion ratio λ will be described later in Examples) is in the following ranges.

In the case of $980 \leq TS \leq 1180$, $\lambda \geq 30\%$

In the case of $1180 \leq TS < 1470$, $\lambda \geq 20\%$

In the case of $1470 \leq TS$, $\lambda \geq 15\%$

The coating layer (hot-dip galvannealing layer) included in the GA steel sheet according to aspects of the present invention has an Fe concentration of 8% to 16% by mass due to the alloying treatment. As in the existing GA steel sheet, the coating may contain, as coating components other than Zn, for example, an appropriate amount of one or more of Al, Mg, Si, and the like (the balance being Zn and unavoidable impurities). Furthermore, in some cases, one or more of Pb, Sb, Fe, Mg, Mn, Ni, Ca, Ti, V, Cr, Co, Sn, and the like may be incorporated.

The GA steel sheet according to aspects of the present invention is suitable for automobile application as a surface-treated steel sheet in which weight reduction and improvement in strength of automobile bodies can be achieved. In addition, the GA steel sheet can be used as a surface-treated steel sheet in which rust-preventing properties are imparted to a base steel sheet in wide applications including home electrical appliances and building materials.

EXAMPLES

Examples of the present invention will be shown below. It is to be understood that the present invention is not limited to the examples.

Each of the slabs having the steel compositions shown in Table 1 was heated in a reheating furnace at 1,260° C. for 60 minutes, then hot-rolled to a thickness of 2.8 mm, and coiled at 540° C. The resulting hot-rolled steel sheet was subjected to pickling to remove mill scales, and then cold-rolled to a thickness of 1.6 mm to obtain a cold-rolled steel sheet.

In a continuous hot-dip galvanizing facility including a reducing furnace (radiant tube type heating furnace), a cooling zone, a molten zinc pot, an IH furnace for alloying, and a light-reduction rolling device in this order from the entry side, under the conditions shown in Table 2 or 4, the cold-rolled steel sheet was sequentially subjected to annealing (annealing step (a)), coating treatment (coating treatment step (b)), alloying treatment (alloying treatment step (c)) and light-reduction rolling (rolling step (x)), and then coiled. Subsequently, in a heating facility in which the atmosphere temperature can be adjusted by gas heating, the GA steel sheet (coil) was subjected to heat treatment (heat treatment step (y)) under the conditions shown in Table 2 or 4. This heat treatment was performed in the air atmosphere without controlling, other than the adjustment of atmosphere temperature. The diameter of the work roll used in light-reduction rolling was 530 mm, and the surface roughness of the work roll was 1.3 μm.

In the continuous hot-dip galvanizing facility, $H_2$—$N_2$ mixed gas was used as the atmosphere gas of the reducing furnace, and the dew point of the atmosphere was controlled by introducing humidifying gas into the reducing furnace. Furthermore, in the hot-dip galvanizing bath contained in the molten zinc pot, the bath temperature was set to be 500° C., and the bath composition was adjusted such that the Al content was 0.1% by mass and the balance consisted of Zn and unavoidable impurities. After the steel sheet was immersed in the hot-dip galvanizing bath, the coating weight was controlled by gas wiping. The alloying treatment after hot-dip galvanizing was performed by heating the steel sheet with the IH heater.

Regarding each of the GA steel sheets obtained as described above, tensile strength (TS), total elongation (EL), critical hole expansion ratio (λ), coating weight and Fe concentration of the coating layer, and "out of hydrogen being present in the steel sheet, the amount of hydrogen that is released when the temperature of the steel sheet is raised to 200° C." were measured. The methods for measuring the individual items are shown below.

Measurement of Tensile Strength (TS) and Total Elongation (EL)

The tensile strength (TS) and the total elongation (EL) were measured by a tensile test. The tensile test was performed in accordance with JIS 22241 (2011), in which, by using a JIS NO. 5 test specimen taken as a sample from the steel sheet such that the tensile direction corresponded to a direction orthogonal to the rolling direction of the steel sheet, the tensile strength (TS) and the total elongation (EL) were measured. Here, as the high-strength, high-ductility GA steel sheet, TS 980 MPa and a product of tensile strength (TS) and total elongation (EL) of 16,000 MPa·% or more are preferred properties.

Measurement of Critical Hole Expansion Ratio (λ)

The critical hole expansion ratio (λ) was measured by a hole-expanding test. The hole-expanding test was performed in accordance with JIS 22256 (2010). The GA steel sheet was cut into a size of 100 mm×100 mm to obtain a specimen. A hole with a diameter of 10 mm was punched in the specimen with a clearance of 12%±1%. Then, using a die with an inside diameter of 75 mm, a 60° conical punch was pushed into the hole with a holding force of 9 ton (88.26 kN)

being applied, and a hole diameter at the crack generation limit was measured. The punch pushing rate was 10 mm/min. A critical hole expansion ratio was obtained from the following formula, and the hole expandability was evaluated based on the critical hole expansion ratio.

$$\text{Critical hole expansion ratio (\%)}=\{(D_f-D_0)/D_0\}\times 100$$

where $D_f$: hole diameter (mm) at the time of crack generation and $D_0$: initial hole diameter (mm).

Here, as the high-strength, high-ductility GA steel sheet, the case where the critical hole expansion ratio (λ) was as described below corresponds to "preferred properties".

In the case of 980≤TS<1180, λ≥30%

In the case of 1180≤TS<1470, λ≥20%

Measurement of Coating Weight and Fe Concentration of Coating Layer

By immersing a specimen (GA steel sheet) in 10 mass percent hydrochloric acid to which a corrosion inhibitor for iron ("IBIT" (registered trademark) manufactured by Asahi Chemical Co., Ltd.) had been added, the coating layer was dissolved. A decrease in the mass of the specimen due to dissolution was measured, and the value obtained by normalizing the measured value with the surface area of the steel sheet was defined as a coating weight ($g/m^2$). Furthermore, by using ICP emission spectrochemical analysis, the amounts of Zn and Fe dissolved in hydrochloric acid were measured, and {Fe dissolution amount/(Fe dissolution amount+Zn dissolution amount)}×100 was defined as the Fe concentration (% by mass) of the coating layer.

Measurement of "Out of Hydrogen being Present in the Steel Sheet, the Amount of Hydrogen that is Released when the Temperature of the Steel Sheet is Raised to 200° C."

The coating layers on the front and back sides of the test specimen of the GA steel sheet were removed by physically grinding using a Leutor, in which the grinding amount for the steel sheet was 5% or less of the sheet thickness. After the coating layers were removed, the amount of hydrogen in the test specimen was measured by programmed temperature gas chromatography. In the gas chromatography, the temperature reached at the time of temperature rise of the test specimen was set to be 200° C., and the rate of temperature rise was set to be 200° C./hr. The value obtained by dividing the amount of hydrogen thus measured by the mass of the steel sheet was defined as "out of hydrogen being present in the steel sheet, the amount of hydrogen that is released when the temperature of the steel sheet is raised to 200° C. (mass ppm)".

Evaluation of Appearance of Coating

The appearance of coating of the GA steel sheet was evaluated as follows.

The appearance of the coating surface of the GA steel sheet was observed, and the appearance of coating was evaluated on the basis of the presence or absence of bare spots and the presence or absence of markings recognized as differences in color tone on the coating surface. That is, 5 places, each ranging 1 $m^2$, were chosen at random, and the presence or absence of bare spots and the presence or absence of markings recognized as differences in color tone were visually checked, and the appearance of coating was evaluated as follows.

A: Bare spots and markings are not observed in all of 5 places (very good)

B: Bare spots are not observed in all of 5 places, but markings are observed in one or more places (average)

C: Bare spots are observed in one or more places (poor)

Confirmation of Cracks in GA Steel Sheet

Cracks in the GA steel sheet were confirmed as follows. The GA surface was observed with a scanning electron microscope (SEM), and the length of cracks present in a region was measured, and a numerical value was calculated by dividing the length by the area of the observed region. This was performed in 10 random regions, and the average thereof was designated as L. Furthermore, cracks extending in a direction at an angle in a range of 80° to 100° with respect to the rolling direction, which were considered as cracks extending in a direction orthogonal to the rolling direction, the length thereof was measured, and the percentage of the measured length relative to the total length of all the cracks was calculated. The specimen with the percentage exceeding 60% was evaluated to be poor (C), and the specimen with the percentage of 60% or less was evaluated to be good (A). Regarding the specimen in which L was less than 0.010 $\mu m/\mu m^2$ or 0.070 $\mu m/\mu m^2$ or more, the percentage of cracks was not calculated.

Measurement of Anti-Powdering Properties

The anti-powdering properties of the GA steel sheet were measured as follows. A CELLOTAPE™ was attached to the GA steel sheet, the taped surface of the steel sheet was bent by 90 degrees and bent back, and the tape was peeled off. The amount of coating adhering to the tape peeled off from the steel sheet was measured as the number of Zn counts by fluorescence X-ray analysis. According to the criteria described below, the steel sheet of rank 2 or less was evaluated to be particularly good (A), the steel sheet of rank 3 was evaluated to be average (B), and the steel sheet of rank 4 or more was evaluated to be poor (C). The steel sheet of rank 3 or less was considered as pass. Furthermore, regarding the steel sheet having an Fe concentration of less than 8% by mass, the anti-powdering test was not performed.

Number of counts by fluorescence X-ray analysis Rank 0 or more and less than 2000: 1 (good)

2000 or more and less than 5000:

5000 or more and less than 8000:

8000 or more and less than 12000:

12000 or more: 5 (poor)

Evaluation of Delayed Fracture Resistance

The delayed fracture resistance of the GA steel sheet was evaluated as follows. A test specimen obtained by preforming was subjected to grinding to obtain a secondary test specimen of 30 mm×100 mm. The secondary test specimen was subjected to 180° bending with a curvature radius of 10 mmR and was fastened such that the distance between sheets was 12 mm to obtain a test specimen for evaluation of delayed fracture. The test specimen for evaluation of delayed fracture was immersed in each of aqueous hydrochloric acid solutions with pH1 and pH3, and occurrence of fractures after 96 hours was checked. This test was carried out on three specimens for each steel sheet, and in the case where fractures occurred in even one specimen, this was considered as occurrence of fractures. The test results were evaluated as follows.

A: No fractures occurred both in the test using the aqueous hydrochloric acid solution with pH1 and in the test using the aqueous hydrochloric acid solution with pH3. (very good)

B: Fractures occurred in the test using the aqueous hydrochloric acid solution with pH1. No fractures occurred in the test using the aqueous hydrochloric acid solution with pH3. (good)

C: Fractures occurred both in the test using the aqueous hydrochloric acid solution with pH1 and in the test using the aqueous hydrochloric acid solution with pH3. (poor)

The measurement and evaluation results together with the production conditions are shown in Tables 2 to 5.

As is evident from Tables 2 to 5, in all the high-strength GA steel sheets of Examples, since the amount of diffusible hydrogen is reduced to a low level, excellent delayed fracture resistance is exhibited, and excellent ductility, hole expandability, and appearance of coating are exhibited. In contrast, in high-strength GA steel sheets of Comparative Examples, since the amount of diffusible hydrogen is large, delayed fracture resistance is poor, and one or more of ductility, hole expandability, and appearance of coating are poor.

TABLE 1

| Steel | Composition (mass %) | | | | | | | | | | | | | | |
|---|---|---|---|---|---|---|---|---|---|---|---|---|---|---|---|
| symbol | C | Si | Mn | Al | P | S | Cr | Mo | B | Nb | Cu | Ni | Ti | $A_{C_1}$ (° C.) | $A_{C_3}$ (° C.) |
| A | 0.12 | 0.03 | 2.4 | 0.03 | 0.01 | 0.004 | — | — | — | — | — | — | — | 715 | 845 |
| B | 0.03 | 0.03 | 2.6 | 0.03 | 0.01 | 0.004 | — | — | — | — | — | — | — | 715 | 881 |
| C | 0.35 | 0.03 | 4.7 | 0.02 | 0.01 | 0.004 | — | — | — | — | — | — | — | 684 | 697 |
| D | 0.12 | 0.03 | 4.3 | 0.03 | 0.01 | 0.004 | — | — | — | — | — | — | — | 693 | 808 |
| E | 0.13 | 0.03 | 6.2 | 0.04 | 0.01 | 0.004 | — | — | — | — | — | — | — | 669 | 768 |
| F | 0.12 | 0.03 | 6.6 | 0.03 | 0.01 | 0.004 | — | — | — | — | — | — | — | 666 | 762 |
| G | 0.12 | 0.2 | 5.0 | 0.02 | 0.01 | 0.004 | — | — | — | — | — | — | — | 690 | 801 |
| H | 0.13 | 0.7 | 3.1 | 0.03 | 0.01 | 0.004 | — | — | — | — | — | — | — | 719 | 865 |
| I | 0.12 | 1.8 | 2.4 | 0.02 | 0.01 | 0.004 | — | — | — | — | — | — | — | 748 | 942 |
| J | 0.13 | 0.03 | 3.4 | 0.30 | 0.01 | 0.004 | — | — | — | — | — | — | — | 658 | 875 |
| K | 0.12 | 0.03 | 3.8 | 1.0 | 0.01 | 0.004 | — | — | — | — | — | — | — | 535 | 1010 |
| L | 0.12 | 0.03 | 2.4 | 0.03 | 0.05 | 0.004 | — | — | — | — | — | — | — | 715 | 845 |
| M | 0.12 | 0.03 | 4.6 | 0.02 | 0.10 | 0.004 | — | — | — | — | — | — | — | 691 | 800 |
| N | 0.13 | 0.02 | 7.7 | 0.03 | 0.01 | 0.009 | — | — | — | — | — | — | — | 653 | 736 |
| O | 0.12 | 0.03 | 4.6 | 0.02 | 0.01 | 0.004 | 0.8 | — | — | — | — | — | — | 711 | 796 |
| P | 0.13 | 0.03 | 4.5 | 0.03 | 0.01 | 0.004 | — | 0.1 | — | — | — | — | — | 693 | 803 |
| Q | 0.13 | 0.02 | 4.7 | 0.03 | 0.01 | 0.004 | — | — | 0.003 | — | — | — | — | 685 | 805 |
| R | 0.12 | 0.03 | 4.5 | 0.05 | 0.01 | 0.004 | — | — | 0.001 | 0.03 | — | — | — | 694 | 811 |
| S | 0.13 | 0.03 | 4.5 | 0.03 | 0.01 | 0.004 | — | 0.1 | — | — | 0.1 | 0.2 | — | 686 | 796 |
| T | 0.12 | 0.02 | 4.7 | 0.04 | 0.01 | 0.004 | — | — | 0.001 | — | — | — | 0.02 | 686 | 807 |
| U | 0.13 | 0.03 | 4.6 | 0.03 | 0.01 | 0.004 | — | — | — | — | — | — | 0.05 | 689 | 804 |
| V | 0.02 | 0.02 | 4.6 | 0.03 | 0.01 | 0.004 | — | — | — | — | — | — | — | 692 | 845 |
| W | 0.36 | 0.03 | 4.7 | 0.02 | 0.01 | 0.004 | — | — | — | — | — | — | — | 684 | 693 |
| X | 0.13 | 0.03 | 1.3 | 0.03 | 0.01 | 0.004 | — | — | — | — | — | — | — | 728 | 862 |

TABLE 2

| | | Production conditions | | | | | | | | | | | | |
|---|---|---|---|---|---|---|---|---|---|---|---|---|---|---|
| | | Annealing step (a) | | | | | Alloy treatment step (c) | Rolling step (x) | | Heat treatment step (y) | | | | |
| | | | Steel | | Atmosphere *4 | | Alloying | Rolling | Work roll | Heating | | Value on | Whether Formula | |
| No. | Steel symbol | T1 (° C.) *1 | sheet temperature (° C.) | Holding time (s) *2 | $H_2$ concentration (%) | Dew point (° C.) | treatment temperature (° C.) | reduction (%) | surface roughness (μm) | temperature T (° C.) | Holding time t (hr) *3 | left side of Formula (1) | (1) is satisfied or not | Classification |
| 1 | A | 737 | 800 | 150 | 5 | −45 | 520 | 0.20 | 1.3 | 100 | 50 | 8727 | YES | Example |
| 2 | A | 737 | 800 | 150 | 5 | −45 | 440 | 0.20 | 1.3 | 100 | 50 | 8727 | YES | Comparative Example |
| 3 | A | 737 | 800 | 150 | 5 | −45 | 540 | 0.20 | 1.3 | 70 | 100 | 8232 | YES | Example |
| 4 | A | 737 | 720 | 150 | 5 | −45 | 520 | 0.20 | 1.3 | 100 | 100 | 8952 | YES | Example |
| 5 | B | 743 | 735 | 150 | 5 | −45 | 460 | 0.80 | 1.3 | 80 | 100 | 8472 | YES | Comparative Example |
| 6 | B | 743 | 735 | 150 | 5 | −45 | 500 | 0.40 | 1.3 | 80 | 100 | 8472 | YES | Example |
| 7 | B | 743 | 750 | 20 | 5 | −45 | 540 | 0.11 | 1.3 | 80 | 100 | 8472 | YES | Example |
| 8 | B | 743 | 750 | 150 | 5 | −45 | 480 | 0.20 | 1.3 | 50 | 100 | 7752 | NO | Comparative Example |
| 9 | C | 686 | 800 | 150 | 10 | −35 | 510 | 0.05 | 1.3 | 80 | 100 | 8472 | YES | Comparative Example* |
| 10 | C | 686 | 800 | 150 | 10 | −35 | 440 | 0.20 | 1.3 | 110 | 100 | 9192 | YES | Comparative Example |
| 11 | C | 686 | 850 | 150 | 10 | −35 | 530 | 0.60 | 1.3 | 70 | 300 | 8559 | YES | Example |
| 12 | D | 712 | 770 | 150 | 10 | −35 | 440 | 0.20 | 1.3 | 150 | 300 | 10556 | YES | Comparative Example |
| 13 | D | 712 | 770 | 150 | 10 | −35 | 570 | 0.20 | 1.3 | 70 | 300 | 8559 | YES | Example |
| 14 | D | 712 | 830 | 150 | 2.5 | −35 | 460 | 0.20 | 1.3 | 60 | 500 | 8458 | YES | Comparative Example |
| 15 | D | 712 | 830 | 150 | 2.5 | −35 | 520 | 0.20 | 1.3 | 60 | 500 | 8458 | YES | Example |
| 16 | E | 686 | 800 | 150 | 10 | −35 | 530 | 0.80 | 1.3 | 60 | 500 | 8458 | YES | Example |

TABLE 2-continued

| | | Production conditions | | | | | | | | | | | | |
|---|---|---|---|---|---|---|---|---|---|---|---|---|---|---|
| | | Annealing step (a) | | | | | Alloy treatment step (c) | Rolling step (x) | | Heat treatment step (y) | | | | |
| | | | Steel | | Atmosphere *4 | | Alloying | Rolling | Work roll | Heating | | Value on | Whether Formula | |
| No. | Steel symbol | T1 (° C.) *1 | sheet temperature (° C.) | Holding time (s) *2 | $H_2$ concentration (%) | Dew point (° C.) | treatment temperature (° C.) | reduction (%) | surface roughness (μm) | temperature T (° C.) | Holding time t (hr) *3 | left side of Formula (1) | (1) is satisfied or not | Classification |
| 17 | E | 686 | 800 | 150 | 10 | −35 | 440 | 0.20 | 1.3 | 120 | 500 | 9981 | YES | Comparative Example |
| 18 | E | 686 | 800 | 150 | 10 | −25 | 560 | 0.20 | 1.3 | 80 | 500 | 8965 | YES | Example |
| 19 | E | 686 | 800 | 150 | 10 | −25 | 510 | 0.20 | 1.3 | 40 | 500 | 7950 | NO | Comparative Example |
| 20 | F | 682 | 740 | 150 | 10 | −35 | 440 | 0.20 | 1.3 | 80 | 500 | 8965 | YES | Comparative Example |

*1 T1 = $A_{C1} + (A_{C3} - A_{C1})/6$
*2 Holding time at steel sheet temperature
*3 Holding time at heating temperature T
*4 Atmosphere at steel sheet temperature of 600° C. to 900 ° C.
*Cracks were not introduced into coating layer by rolling in rolling step (x).

TABLE 3

| | Structure and properties of GA steel sheet | | | | | | | | | | | | | | |
|---|---|---|---|---|---|---|---|---|---|---|---|---|---|---|---|
| | Coating weight | | Fe concentration of coating layer | | Amount of hydrogen that is released when temperature of steel sheet is increased | | | | | Appearance of coating | Cracks in coating | | Anti-powdering properties | Delayed fracture resistance Evaluation | |
| No. | Front side (g/m²) | Back side (g/m²) | Front side (mass %) | Back side (mass %) | to 200° C. (mass ppm) | TS (MPa) | El (%) | TS × El | λ (%) | | L (μm/μm²) | Percentage | | | Classification |
| 1 | 75 | 73 | 11.2 | 11.1 | 0.23 | 1020 | 18.4 | 18771 | 40 | A | 0.039 | A | A | B | Example |
| 2 | 67 | 69 | 0.2 | 0.3 | 0.61 | 1063 | 17.5 | 18614 | 14 | A | 0.002 | — | — | C | Comparative Example |
| 3 | 64 | 64 | 13.5 | 13.5 | 0.21 | 1008 | 18.1 | 18214 | 42 | A | 0.040 | A | A | B | Example |
| 4 | 68 | 70 | 11.0 | 11.1 | 0.12 | 1025 | 13.0 | 13325 | 50 | A | 0.052 | A | A | A | Example |
| 5 | 67 | 68 | 7.2 | 7.2 | 0.36 | 1100 | 16.7 | 18404 | 27 | A | — | — | — | C | Comparative Example |
| 6 | 61 | 60 | 9.0 | 8.9 | 0.14 | 1044 | 17.5 | 18229 | 42 | A | 0.061 | A | A | B | Example |
| 7 | 22 | 24 | 9.8 | 9.6 | 0.05 | 1084 | 12.2 | 13225 | 44 | A | 0.024 | A | A | A | Example |
| 8 | 41 | 40 | 8.3 | 8.4 | 0.48 | 1064 | 17.6 | 18704 | 25 | A | 0.057 | A | A | C | Comparative Example |
| 9 | 73 | 72 | 11.7 | 11.6 | 0.41 | 1327 | 17.3 | 22942 | 17 | A | — | — | A | C | Comparative Example |
| 10 | 69 | 70 | 0.3 | 0.4 | 0.52 | 1360 | 16.7 | 22699 | 14 | A | — | — | — | C | Comparative Example |
| 11 | 62 | 59 | 12.2 | 12.3 | 0.02 | 1329 | 17.2 | 22867 | 31 | A | 0.078 | — | B | A | Example |
| 12 | 72 | 73 | 0.2 | 0.3 | 0.42 | 1291 | 17.7 | 22788 | 15 | A | 0.005 | — | — | C | Comparative Example |
| 13 | 67 | 65 | 16.4 | 16.5 | 0.05 | 1211 | 18.5 | 22380 | 28 | A | 0.064 | A | A | A | Example |
| 14 | 59 | 62 | 5.3 | 5.1 | 0.46 | 1281 | 17.2 | 22093 | 14 | B | 0.007 | — | — | C | Comparative Example |
| 15 | 55 | 57 | 11.6 | 11.6 | 0.12 | 1257 | 18.2 | 22923 | 25 | B | 0.042 | A | A | A | Example |
| 16 | 115 | 112 | 12.3 | 12.3 | 0.08 | 1512 | 17.3 | 26126 | 20 | A | 0.075 | C | B | A | Example |
| 17 | 52 | 50 | 0.4 | 0.5 | 0.38 | 1534 | 17.0 | 26045 | 13 | A | 0.008 | — | — | C | Comparative Example |
| 18 | 40 | 38 | 15.1 | 15.2 | 0.01 | 1495 | 17.8 | 26607 | 23 | B | 0.059 | A | B | A | Example |
| 19 | 47 | 49 | 10.8 | 10.7 | 0.39 | 1512 | 17.7 | 26815 | 10 | B | 0.033 | A | A | C | Comparative Example |
| 20 | 46 | 48 | 0.3 | 0.2 | 0.41 | 1588 | 16.8 | 26647 | 12 | A | 0.007 | — | — | C | Comparative Example |

* Underlined items are outside the range of the present invention.

TABLE 4

| | | Production conditions | | | | | | | | | | | | |
|---|---|---|---|---|---|---|---|---|---|---|---|---|---|---|
| | | Annealing step (a) | | | | | Alloy treatment step (c) | Rolling step (x) | | Heat treatment step (y) | | | | |
| | | | Steel | | Atmosphere *4 | | | | | | | | | |
| No. | Steel symbol | T1 (° C.) *1 | sheet temperature (° C.) | Holding time (s) *2 | $H_2$ concentration (%) | Dew point (° C.) | Alloying treatment temperature (° C.) | Rolling reduction (%) *5 | Work roll surface roughness (μm) | Heating temperature T (° C.) | Holding time t (hr) *3 | Value on left side of Formula (1) | Whether Formula (1) is satisfied or not | Classification |
| 21 | F | 682 | 740 | 150 | 10 | −35 | 520 | 0.20 | 1.3 | 60 | 500 | 8458 | YES | Example |
| 22 | F | 682 | 740 | 150 | 10 | −35 | 530 | — | 1.3 | 60 | 500 | 8458 | YES | Comparative Example |
| 23 | F | 682 | 740 | 150 | 10 | −35 | 500 | 0.20 | 1.3 | 60 | 500 | 8458 | YES | Example |
| 24 | G | 708 | 800 | 150 | 5 | −35 | 520 | 0.20 | 1.3 | 80 | 100 | 8472 | YES | Example |
| 25 | H | 743 | 800 | 150 | 5 | −35 | 520 | 0.20 | 1.3 | 80 | 100 | 8472 | YES | Example |
| 26 | I | 780 | 800 | 150 | 5 | −35 | 520 | 0.20 | 1.3 | 80 | 100 | 8472 | YES | Example |
| 27 | J | 694 | 800 | 150 | 5 | −35 | 520 | 0.20 | 1.3 | 80 | 100 | 8472 | YES | Example |
| 28 | K | 614 | 800 | 150 | 5 | −35 | 520 | 0.20 | 1.3 | 80 | 100 | 8472 | YES | Example |
| 29 | L | 737 | 800 | 150 | 5 | −35 | 520 | 0.20 | 1.3 | 80 | 100 | 8472 | YES | Example |
| 30 | M | 709 | 800 | 150 | 5 | −35 | 520 | 0.20 | 1.3 | 80 | 100 | 8472 | YES | Example |
| 31 | N | 667 | 800 | 150 | 5 | −35 | 520 | 0.20 | 1.3 | 80 | 100 | 8472 | YES | Example |
| 32 | O | 725 | 800 | 150 | 5 | −35 | 520 | 0.20 | 1.3 | 80 | 100 | 8472 | YES | Example |
| 33 | P | 711 | 800 | 150 | 5 | −35 | 520 | 0.20 | 1.3 | 80 | 100 | 8472 | YES | Example |
| 34 | Q | 705 | 800 | 150 | 5 | −35 | 520 | 0.20 | 1.3 | 80 | 100 | 8472 | YES | Example |
| 35 | R | 713 | 800 | 150 | 5 | −35 | 520 | 0.20 | 1.3 | 80 | 100 | 8472 | YES | Example |
| 36 | S | 704 | 800 | 150 | 5 | −35 | 520 | 0.20 | 1.3 | 80 | 100 | 8472 | YES | Example |
| 37 | T | 706 | 800 | 150 | 5 | −35 | 520 | 0.20 | 1.3 | 80 | 100 | 8472 | YES | Example |
| 38 | U | 708 | 800 | 150 | 5 | −35 | 520 | 0.20 | 1.3 | 80 | 100 | 8472 | YES | Example |
| 39 | V | 718 | 750 | 150 | 5 | −35 | 520 | 0.20 | 1.3 | 80 | 100 | 8472 | YES | Example |
| 40 | W | 685 | 760 | 150 | 5 | −35 | 520 | 0.20 | 1.3 | 80 | 100 | 8472 | YES | Example |
| 41 | X | 750 | 800 | 150 | 5 | −35 | 520 | 0.20 | 1.3 | 80 | 100 | 8472 | YES | Example |

*1 $T1 = A_{C1} + (A_{C3} - A_{C1})/6$
*2 Holding time at steel sheet temperature
*3 Holding time at heating temperature T
*4 Atmosphere at steel sheet temperature of 600° C. to 900° C.
*5 "—" means not being subjected to rolling step (x).

TABLE 5

| | Structure and properties of GA steel sheet | | | | | | | | | | | | | | |
|---|---|---|---|---|---|---|---|---|---|---|---|---|---|---|---|
| | Coating weight | | Fe concentration of coating layer | | Amount of hydrogen that is released when temperature of steel sheet is increased to | | | | | Appearance of coating | Cracks in coating | | Anti-powdering properties | Delayed fracture resistance Evaluation | |
| No. | Front side ($g/m^2$) | Back side ($g/m^2$) | Front side (mass %) | Back side (mass %) | 200° C. (mass ppm) | TS (MPa) | El (%) | TS × El | λ (%) | | L (μm/$\mu m^2$) | Percentage | | | Classification |
| 21 | 68 | 67 | 11.5 | 11.6 | 0.12 | 1531 | 17.6 | 26999 | 25 | A | 0.037 | A | A | A | Example |
| 22 | 51 | 54 | 12.5 | 12.6 | 0.44 | 1520 | 17.5 | 26642 | 8 | A | — | — | A | C | Comparative Example |
| 23 | 54 | 51 | 10.1 | 10.0 | 0.19 | 1571 | 17.0 | 26716 | 19 | A | 0.026 | A | A | B | Example |
| 24 | 48 | 50 | 11.5 | 11.5 | 0.18 | 1365 | 16.6 | 22655 | 32 | A | 0.044 | A | A | B | Example |
| 25 | 61 | 59 | 11.6 | 11.7 | 0.17 | 1128 | 20.2 | 22805 | 43 | A | 0.051 | A | A | B | Example |
| 26 | 63 | 61 | 11.2 | 11.4 | 0.17 | 1040 | 22.1 | 22986 | 42 | A | 0.047 | A | A | A | Example |
| 27 | 54 | 52 | 11.0 | 11.2 | 0.18 | 1165 | 19.1 | 22247 | 38 | A | 0.033 | A | A | B | Example |
| 28 | 74 | 73 | 10.9 | 10.9 | 0.16 | 1215 | 18.6 | 22614 | 30 | A | 0.057 | A | A | B | Example |
| 29 | 54 | 52 | 11.9 | 12.1 | 0.17 | 1040 | 21.6 | 22444 | 37 | A | 0.055 | A | A | B | Example |
| 30 | 53 | 53 | 11.8 | 11.8 | 0.15 | 1315 | 17.1 | 22521 | 29 | A | 0.041 | A | A | B | Example |
| 31 | 57 | 58 | 11.4 | 11.5 | 0.16 | 1510 | 14.7 | 22267 | 20 | A | 0.059 | A | A | A | Example |
| 32 | 64 | 62 | 11.5 | 11.4 | 0.16 | 1315 | 17.0 | 22386 | 32 | A | 0.058 | A | A | B | Example |
| 33 | 62 | 59 | 11.0 | 11.1 | 0.17 | 1303 | 17.4 | 22681 | 31 | A | 0.040 | A | A | B | Example |
| 34 | 69 | 68 | 11.2 | 11.4 | 0.15 | 1328 | 16.8 | 22292 | 33 | A | 0.047 | A | A | B | Example |
| 35 | 62 | 63 | 11.9 | 12.0 | 0.15 | 1303 | 17.6 | 22909 | 28 | A | 0.049 | A | A | A | Example |
| 36 | 44 | 42 | 10.8 | 10.9 | 0.16 | 1303 | 17.0 | 22116 | 22 | A | 0.027 | A | A | A | Example |
| 37 | 58 | 59 | 11.8 | 12.0 | 0.18 | 1328 | 17.2 | 22838 | 26 | A | 0.052 | A | A | B | Example |
| 38 | 36 | 35 | 11.5 | 11.6 | 0.15 | 1315 | 17.5 | 22990 | 22 | A | 0.034 | A | A | A | Example |
| 39 | 73 | 71 | 10.2 | 10.0 | 0.17 | 920 | 20.1 | 18492 | 35 | A | 0.018 | A | A | B | Example |

TABLE 5-continued

| | Structure and properties of GA steel sheet | | | | | | | | | | | | | | |
|---|---|---|---|---|---|---|---|---|---|---|---|---|---|---|---|
| | Coating weight | | Fe concentration of coating layer | | Amount of hydrogen that is released when temperature of steel sheet is increased to | | | | | Appearance of | Cracks in coating | | Anti-powdering properties | Delayed fracture resistance Evaluation | |
| No. | Front side ($g/m^2$) | Back side ($g/m^2$) | Front side (mass %) | Back side (mass %) | 200° C. (mass ppm) | TS (MPa) | El (%) | TS × El | λ (%) | coating | L (μm/$\mu m^2$) | Percentage | | | Classification |
| 40 | 39 | 42 | 10.8 | 10.7 | 0.19 | 1328 | 8.9 | 11815 | 31 | A | 0.042 | A | A | B | Example |
| 41 | 65 | 63 | 11.4 | 11.3 | 0.16 | 903 | 18.3 | 16516 | 39 | A | 0.048 | A | A | B | Example |

* Underlined items are outside the range of the present invention.

The invention claimed is:

1. A hot-dip galvannealed steel sheet, which includes a steel sheet serving as a base material, wherein a coating layer has an Fe concentration of 8% to 17% by mass, and out of hydrogen being present in the steel sheet, an amount of hydrogen that is released when a temperature of the steel sheet is increased to 200° C. is 0.35 mass ppm or less, wherein an average length (L) per unit area of microcracks introduced into the coating layer at a surface of the steel sheet is 0.010 μm/$\mu m^2$ or more and 0.070 μm/$\mu m^2$ or less, in which a percentage of cracks that extend in a direction at an angle in a range of 80° to 100° with respect to the direction in which the steel sheet to be rolled is passed is 60% or less relative to a total length of all the cracks.

2. The hot-dip galvannealed steel sheet according to claim 1, wherein the steel sheet has a composition containing, in percent by mass, C: 0.03% to 0.35%, Si: 0.01% to 2.00%, Mn: 2.0% to 10.0%, Al: 0.001% to 1.000%, P: 0.10% or less, and S: 0.01% or less with the balance being Fe and unavoidable impurities, and has a tensile strength of 980 MPa or more, and a product (TS×EL) of tensile strength (TS) and total elongation (EL) of 16,000 MPa % or more; and a coating weight per one side of the coating layer is 20 to 120 $g/m^2$.

3. The hot-dip galvannealed steel sheet according to claim 2, wherein the steel sheet further contains, in percent by mass, one or more selected from B: 0.001% to 0.005%, Nb: 0.005% to 0.050%, Ti: 0.005% to 0.080%, Cr: 0.001% to 1.000%, Mo: 0.05% to 1.00%, Cu: 0.05% to 1.00%, Ni: 0.05% to 1.00%, and Sb: 0.001% to 0.200%.

* * * * *